United States Patent [19]

Simo

[11] 4,006,901

[45] Feb. 8, 1977

[54] ARROWHEAD

[75] Inventor: Miroslav Andrew Simo, Riverside, Ill.

[73] Assignee: New Archery Products Corporation, Riverside, Ill.

[22] Filed: Oct. 6, 1975

[21] Appl. No.: 619,824

[52] U.S. Cl. ..... 273/106.5 B

[51] Int. Cl.[2] ..... F41B 5/02

[58] Field of Search ..... 273/106.5 B, 106.5 C, 273/106.5 R

[56] References Cited

UNITED STATES PATENTS

| | | | |
|---|---|---|---|
| 2,289,284 | 7/1942 | Chandler | 273/106.5 B |
| 2,676,017 | 4/1954 | Selent et al. | 273/106.5 B |
| 2,816,766 | 12/1957 | Stockfleth | 273/106.5 B |
| 2,940,758 | 6/1960 | Richter | 273/106.5 B |
| 3,398,960 | 8/1968 | Carroll, Jr. | 273/106.5 B |
| 3,527,463 | 9/1970 | Turner | 273/106.5 B |
| 3,910,579 | 10/1975 | Sprandel | 273/106.5 B |
| 3,915,455 | 10/1975 | Savora | 273/106.5 B |

FOREIGN PATENTS OR APPLICATIONS

| | | | |
|---|---|---|---|
| 445,590 | 4/1936 | United Kingdom | 273/106.5 R |
| 589,208 | 6/1947 | United Kingdom | 273/106.5 R |

*Primary Examiner*—Paul E. Shapiro
*Attorney, Agent, or Firm*—Thomas W. Speckman

[57] ABSTRACT

An arrowhead assembly having an adapter at the head end of an arrow shaft, an arrowhead body forming a hollow cylinder providing freely rotatable movement when the adapter shaft is inserted therein, multiple blades firmly mounted within the arrowhead body and having a shape exterior to the arrowhead body adapted for good aerodynamic flight characteristics and deep target penetration and a conical nose piece fastening to the adapter shaft in fixed relation to the adapter shaft allowing freely rotatable movement of the arrowhead body and blades with respect to the nose piece and adapter shaft. The arrowhead of this invention affords firm alignment with the arrow shaft and ready exchangeability of the arrowhead body including all of the blades. The arrowhead of this invention provides a structure wherein the blades can be adjusted to rotate or remain stationary with respect to the arrow shaft and nose piece, if desired.

15 Claims, 7 Drawing Figures

ARROWHEAD

This invention relates to an arrowhead which is useful for hunting and provides easy and safe exchange of multiple blade arrowhead body units having different numbers of blades and blade configurations and the choice of having the blades rotate or remain stationary relative to the nose piece and arrow shaft during penetration of a target.

A number of attempts have been made to provide arrowheads with replaceable cutting blades, but these have not been entirely satisfactory. For example, the arrow tip disclosed in U.S. Pat. No. 3,756,600 shows the use of razor blades held in grooves of an arrow tip by a snap ring. However, this design is not entirely satisfactory since it is difficult to replace the blades and the shape of the blades provides a barb at the rear end which renders them unlawful for use in many states. Further, the arrowhead of the U.S. Pat. 3,756,600 is fixed with respect to rotation of the arrow shaft. Other attempts to solve the problem of providing readily replaceable blades to arrowheads are illustrated in U.S. Pat. Nos. 3,741,542, 3,854,723 and 2,940,758. The arrowheads as taught by each of these patents have the disadvantage of blades being individually mounted and difficult to readily exchange, particularly in the field under hunting conditions. Rotating arrow tips are also known to the art as disclosed in U.S. Pat. No. 3,527,463, however, arrow tips such as disclosed in that patent are not readily exchangeable, present difficulty in alignment of the arrowhead with the arrow shaft and do not provide for rotation of the blades relative to the tip portion. The arrowheads of the present invention rotate with the arrow shaft while in flight, but upon penetration of a target material rotate relative to the arrow shaft and nose piece so that a greater portion of the arrow's energy is available for penetration of the target material.

It is an object of this invention to overcome the disadvantages of prior arrowheads.

It is an object of this invention to provide a readily removable arrowhead affording good alignment with the arrow shaft and easy means for securement of the arrowhead to the arrow shaft.

It is another object of this invention to provide an arrowhead having a readily exchangeable arrowhead body including all of the blades.

It is yet another object of this invention to provide a readily removable arrowhead wherein the arrowhead body including all of the blades can be adjusted to rotate or to remain stationary with respect to the arrow shaft and nose piece, as desired.

It is yet another object of this invention to provide an arrowhead wherein the tip of the arrowhead does not rotate with the rotation of the blades.

It is another object of this invention to provide a hunting arrowhead having the same weight as a target arrow tip.

It is still another object of this invention to provide a readily exchangeable arrowhead body including all of the blades wherein the blades do not have a barb effect upon penetration.

It is yet another object of this invention to provide a smoothly streamlined arrowhead which may have 2 to 7 blades, the larger number of blades reducing the width of the blades, minimizing wind resistance and noise while increasing penetration of a target.

These and other features and advantages of this invention will become apparent from consideration of the description when taken in conjunction with the drawing showing preferred embodiments of this invention wherein.

Figure 1:
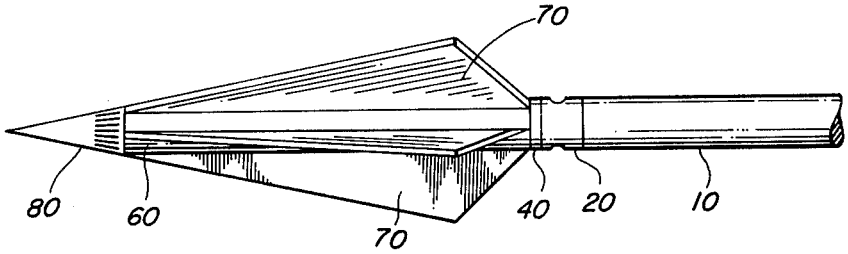
FIG. 1 is a side view of an arrowhead incorporating principles of this invention in the assembled position on an arrow shaft.
Figure 2:
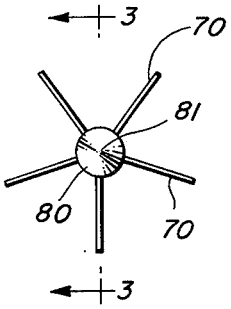
FIG. 2 is an end view of the arrowhead shown in FIG. 1.

The arrowhead of this invention has three principal components shown in the drawings as nose piece 80, arrowhead body 60 carrying blades 70 and adapter 20 for securing the arrowhead assembly to arrow shaft 10. Body spacer 40 is used when it is desired that arrowhead body 60 carrying blades 70 not rotate with respect to arrow shaft 10 and nose piece 80 upon penetration of a target.

In assembling the arrowhead of this invention, adapter 20 is first tightened into aligned relationship with arrow shaft 10. Adapter 20 has arrow shaft extension portion 23 which may be approximately the same shape and diameter as the end of arrow shaft 10. Adjacent to arrow shaft extension portion 23 is adapter shaft 21 of smaller diameter and providing snug fitting relationship with adapter shaft receiving cylinder 12 in the end of arrow shaft 10. At the end of adapter 20 received within arrow shaft 10 is adapter threaded shaft 26 which is received in threaded relationship by matching thread receiving cylinder 11 in shaft 10. Thus, adapter 20 may be tightened in rigid aligned position with respect to arrow shaft 10 by fully tightening the screw threads of adapter threaded shaft 26, thereby obtaining a tight, adjacent shoulder relationship with the shoulders between adapter threaded shaft 26 and adapter shaft 21 and between adapter shaft 21 and arrow shaft extension portion 23. Tightening of adapter 20 may be facilitated by insertion of a stiff piece of wire or other material through tightening hole 22 to serve as a handle for the tightening action. Adapter 20 has adapter shaft 24 of suitable length and diameter to loosely fit within adapter shaft cylinder 61 of arrowhead body 60. The looseness of this fit should not permit undesired wobble but should permit easy rotation of arrow body 70 around adapter shaft 24 upon penetration of object. The end of adapter shaft 24 has nose piece receiving cylinder 25 with threads matching those of nose piece thread shaft 85.

It must be appreciated that the essential feature of adapter 20 is the provision of adapter shaft 24 and nose piece receiving cylinder 25. It is within this invention that adapter shaft 24 and nose piece receiving cylinder 25 be provided by shaping the end of arrow shaft 10, thus not requiring a separate adapter 20. Likewise, when wooden arrow shafts are used, an adapter providing adapter shaft 24 and nose piece receiving cylinder 25 may be glued over the end of the wooden shaft. As shown in the FIGS. 1 and 3 arrow shaft 10 is a hollow aluminum or fiberglass shaft with an adapter. plug fastened in the end of the shaft to receive adapter shaft 21 and adapter threads 26. Arrow shaft extension portion 23, although shown in the figures as the same diameter as arrow shaft 10, may be either larger or smaller in diameter.

Figure 3:
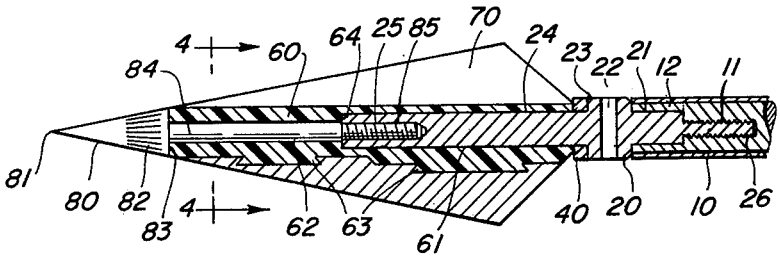
FIG. 3 is a partial cross-sectional assembled view of the arrowhead shown in FIG. 1 along the lines of 3—3 as shown in FIG. 2.
Figure 4:
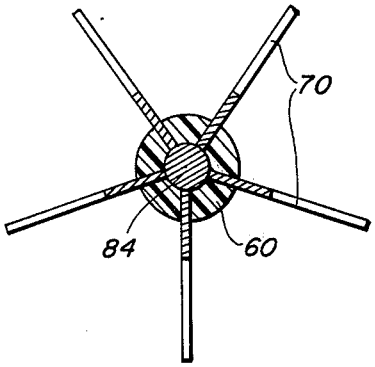
FIG. 4 is a cross-sectional view of the arrowhead of this invention shown along the lines 4—4 of FIG. 3.
Figure 5:
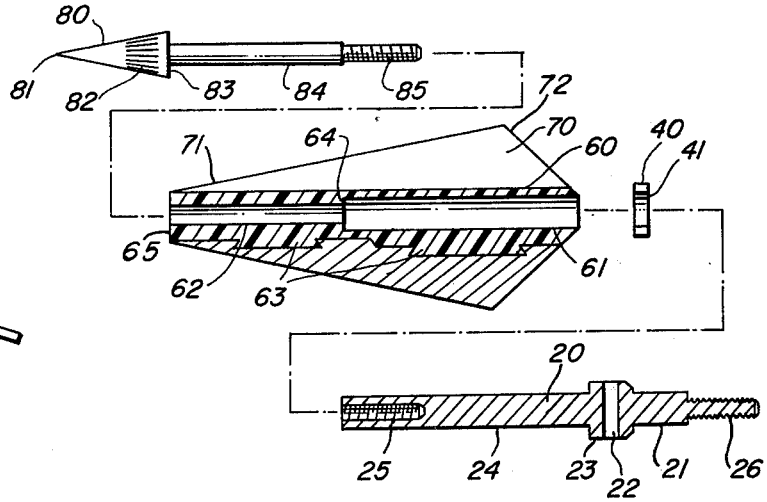
FIG. 5 is a disassembled view of the components of the arrowhead shown in FIG. 1.

Arrowhead body 60 carries the desired number of blades 70 firmly embedded within arrowhead body 60. Two to about 7 blades are suitable dependent upon the purpose of the arrowhead. Blades 70 may be of any desired shape having straight, concave or convex leading edges. It is desired that the trailing edge of the blades not have a barb, but present easy withdrawal from a target. To hold the blades firmly in arrowhead body 60 the blades may have cutout portions which may be holes or notches of any shape where they are embedded within arrowhead body 60 so that the moldable plastic flows through the openings providing for rigid securement of each blade to the arrowhead body. One embodiment is shown in FIGS. 3 and 5 as blade securing means 63. The portion of the blade external to the arrowhead body may be of any desired shape, a particularly desired shape is shown in the drawings, having sharpened trailing edge 72 for easy removal of the arrowhead after penetration into a body. The shape of blades 70 as shown in the figures is particularly preferred since it affords a continuously streamlined shape minimizing the overall diameter of the arrowhead when multiple blades, such as five, are used. Further, the smaller diameter reduces wind resistance and eliminates the necessity for weight reduction cutouts in the blades which create a noise problem.

Nose piece 80 holds arrowhead body 60 in place upon adapter 20. Nose piece 80 has nose piece shaft 84 terminating in nose piece threads shaft 84 for screwable insertion into matching thread cylinder 25 in adapter shaft 24. It is preferred that nose piece shaft 84 be smaller in diameter than adapter shaft 24 to provide for thicker arrowhead body 60 to more securely hold the forward ends of blades 70. Nose piece 80 has conical point 81 upon which serrations 82 may be provided toward the larger end. Point 81 may be sharpened and of a hardened material, such as steel, to facilitate deeper penetration upon striking an object or may have slight blunt to prevent curling upon striking a hard object. Serrations 82 may also be of a sharpened knife-like configuration to facilitate entry of the arrowhead point into an object. Nose piece shaft 84 and nose piece shaft cylinder 62 are sized so as to permit rotation of arrowhead body 70 on nose piece shaft 84. The length of nose piece shaft 84 is adjusted so that arrowhead body 60 rotates freely on shaft 84 with a small space between end 65 and shoulder 83. It is preferred that the threads not extend to the end of nose piece threads shaft 85 and matching thread cylinder 25 in adapter 20 and that the end of shaft 85 be adapted to bottom firmly against the end of cylinder 25. When the end of shaft 85 firmly engages the bottom of cylinder 25, the thrust and bending imparted by striking a target is transmitted from nose piece 80 to adapter 20 to arrow shaft 10.

Figure 6:
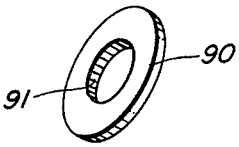
FIG. 6 is a perspective view of a suitable wrench for use in assembly of the arrowhead shown in FIG. 1.
Figure 7:
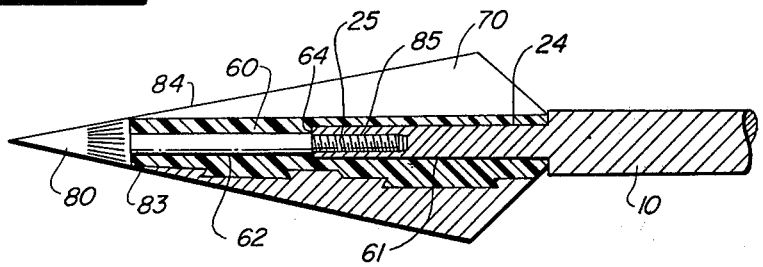
FIG. 7 is a partial cross-sectional view of an embodiment of an arrowhead of this invention wherein the adapter shaft is provided by the end of the arrow shaft.

FIG. 6 shows wrench 90 having serrations 91 which mesh with serrations 82 on nose piece 80. Wrench 90 can be a washer of soft metal such as aluminum so that when engaged with hardened serrations 82 the pressure will form meshing serrations 91. Wrench 90 is useful in tightening nose piece 80 to adapter 20. Nose piece 80 may also have a hole similar to tightening hole 22 for tightening the nose piece in place.

As described above, arrowhead body 60 is freely rotatable with respect to arrow shaft 10 and nose piece 80. If it is desired to prevent the rotation of arrowhead body 60, body spacer 40 having hole 41 loosely fitting over adapter shaft 24. Body spacer 40 may be inserted over adapter shaft 24 between arrowhead body 60 and arrow shaft extension portion 23 so that when nose piece 80 is tightened arrowhead body 60 is held firmly and in non-rotatable relation with arrow shaft 10 and nose piece 80.

While the above description has referred to threaded fastening means for assembling the nose piece, adapter and arrow shaft, it is recognized that any suitable fastening means may be used. For example, bayonet or O-ring and groove fastening means may be used. The terminology fastening means is meant to include all appropriate fastening methods for assembling the nose piece to the adapter and arrow shaft.

The components of the arrowhead of this invention may polyphenyleneoxide, fabricated from any suitable materials. It is preferred that the nose piece be fabricated from hardened steel. In order to minimize weight of the arrowhead assembly, it is preferred that the adapter be fabricated from aluminum, titanium, magnesium or other lightweight metal alloy. It is preferred that the nose piece and adapter be metal since they must resist both thrust and bending forces when the arrowhead strikes a target. The blades are most suitably fabricated from steel or steel alloys which will take and maintain the desired sharpened edge. The arrowhead body is suitably fabricated from any high impact moldable plastic such as nylon, polyethylene, polystyrene, polycarbonate, polyacetal, polysulfone, polyhenyleneoxide, polyesters and the like. The materials of construction may be selected so that the arrow and arrowhead assembly have a similar weight distribution as a target arrow and thus, the shooter does not have to allow for different weight arrows.

As can be readily seen from the above description, a wide variety of arrowhead bodies carrying different configurations and numbers of blades may be interchanged using the same arrow shaft adapter and nose piece. Thus, the different arrowhead bodies may be marketed separately for interchange on an arrow shaft.

A plastic sheath may be fabricated to cover the exposed blade portions when handling or storing the arrowhead body. A sheath of semi-rigid plastic wherein the front portion of the arrowhead body is exposed, may serve for safe handling of the arrowhead body with its blades upon assembly of the arrowhead.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles if the invention.

I claim:

1. An arrowhead assembly for attachment to the head end of an arrow shaft comprising:

an adapter shaft having a head end and an other end, said other end having fastening means for securement to said head end of an arrow shaft and means for fastening a nosepiece at said adapter shaft head end;

an arrowhead body forming a hollow cylinder, said hollow cylinder having a diameter greater than said adapter shaft providing freely rotatable movement when said adapter shaft is inserted in said hollow cylinder, multiple blades firmly mounted within said body and having a shape exterior to said arrowhead body adapted for good aerodynamic flight characteristics and keep target penetration; and a conical nosepiece having a fastening means at its tail end for mating with said fastening means in the head end of the adapter shaft fastening said nosepiece in fixed relation to said adapter shaft and said arrow shaft while allowing freely rotatable movement of said arrowhead body and blades.

2. The arrowhead assembly of claim 1 wherein said adapter shaft is at the head end of a separate adapter piece, said adapter shaft having fastening means in the other end thereof to firmly hold said adapter shaft in aligned position at the head end of said adapter piece.;

3. The arrowhead assembly of claim 1 wherein said fastening means are threaded and said adapter shaft has a tightening hole therethrough for insertion of a tightening handle for tightening said adapter shaft upon siad arrow shaft.; and

4. The arrowhead assembly of claim 1 wherein said arrowhead body is a high impact moldable plastic.

5. The arrowhead assembly of claim 4 wherein said blades have cutout securing means so that the moldable plastic flows through the openings providing rigid securement to the arrowhead body.

6. The arrowhead assembly of claim 1 wherein said arrowhead body has 2 to about 7 blades firmly mounted therein.

7. The arrowhead assembly of claim 6 wherein the arrowhead body has 5 blades firmly mounted therein.

8. The arrowhead assembly of claim 1 wherein said conical nose piece has serrations along at least a portion of its tapering surface.

9. The arrowhead assembly of claim 1 wherein said conical nose piece is made of hardened steel and has a slightly blunted point to prevent curling upon striking a hard object.

10. The arrowhead assembly of claim 1 wherein said conical nose piece when fastened to said adapter shaft firmly engages the adapter shaft so that the thrust and bending imparted upon striking a target is transmitted from the nose piece to the adapter.

11. The arrowhead assembly of claim 10 wherein said nosepiece has a threaded shaft at the tail end thereof for engagement with a threaded cylinder in the head end of said adapter shaft, the end of said nosepiece threaded shaft and the bottom of said threaded cylinder having matching truncated conical shape for firm engagement to transmit the thrust and bending imparted upon striking a target from the nosepiece to the adapter to the arrow shaft.

12. The arrowhead assembly of claim 1 additionally having a spacer fitting over said adapter shaft and in firm contact with the rear of said arrowhead body when said nose piece is tightened, said arrowhead body being heald firmly and in non-rotatable relation with respect to said arrow shaft and nose piece.

13. The arrowhead assembly of claim 1 wherein said nosepiece has a shaft at its tail end, the nosepiece shaft having a smaller diameter than said adapter shaft, said arrowhead body hollow cylinder having a diameter greater than said nosepiece shaft and a diameter greater than said adapter shaft in the respective portions in which they are each inserted providing freely rotatable movement of said arrowhead body.

14. The arrowhead assembly of claim 1 wherein said blades have straight leading edges increasing exposed blade depth from the head end of said arrowhead body and straight trailing edges decreasing exposed blade depth toward the other end of said arrowhead body.

15. An arrowhead assembly comprising:

an arrow shaft having a head end, an adapter shaft having a head end and an other end, said adapter shaft provided by shaping said arrow shaft head end and having means for fastening a nosepiece at said adapter shaft head end;

an arrowhead body forming a hollow cylinder, said hollow cylinder having a diameter greater than said adapter shaft providing freely rotatable movement when said adapter shaft is inserted in said hollow cylinder, multiple blades firmly mounted within said body and having a shape exterior to said arrowhead body adapted for good aerodynamic flight characteristics and deep target penetration; and a conical nosepiece having a fastening means at its tail end for mating with said fastening means in the head end of the adapter shaft fastening said nosepiece in fixed relation to said adapter shaft and said arrow shaft while allowing freely rotatable movement of said arrowhead body and blades.

* * * * *